United States Patent [19]

Mancini

[11] 4,176,507

[45] Dec. 4, 1979

[54] CONDIMENT PACKAGING MACHINE

[75] Inventor: Derek V. Mancini, Stouffville, Canada

[73] Assignee: Consumers Glass Company Limited, Toronto, Canada

[21] Appl. No.: 893,314

[22] Filed: Apr. 3, 1978

[51] Int. Cl.[2] ..... B65B 7/28

[52] U.S. Cl. ..... 53/478; 53/282; 53/329

[58] Field of Search ..... 53/477, 478, 282, 329

[56] References Cited

U.S. PATENT DOCUMENTS 3,527,020 9/1970 Mancini ..... 53/282

3,783,581 1/1974 Pierce ..... 53/282 X

*Primary Examiner*—Travis S. McGehee

[57] ABSTRACT

The specification discloses an apparatus adapted to heat seal a lid of a series of like lids, interconnected by severable tabs, to an open container. The apparatus comprises a driven conveyor for conveying the containers and a lid heat-sealing and tab-severance station. The containers are momentarily stationed beneath the lid heat sealing and tab severance station to press and heat seal an aligned lid onto a supported container rim. The tab which interconnects the sealed lid to the supply of series of like interconnected lids, is severed prior to the conveyor advancing the next container to be sealed.

18 Claims, 15 Drawing Figures

FIG. 4.
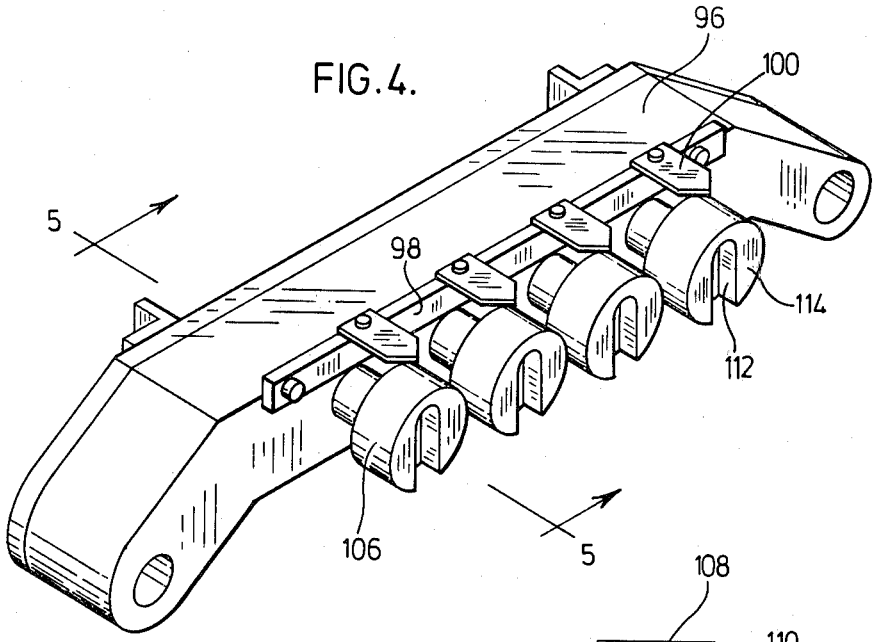
FIG. 5.
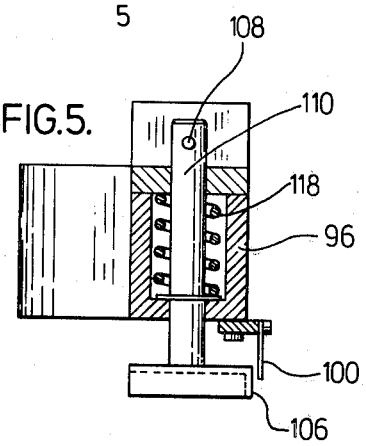
FIG. 7.
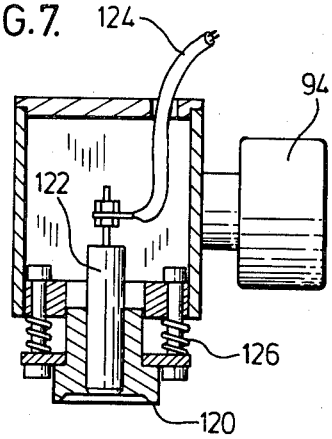
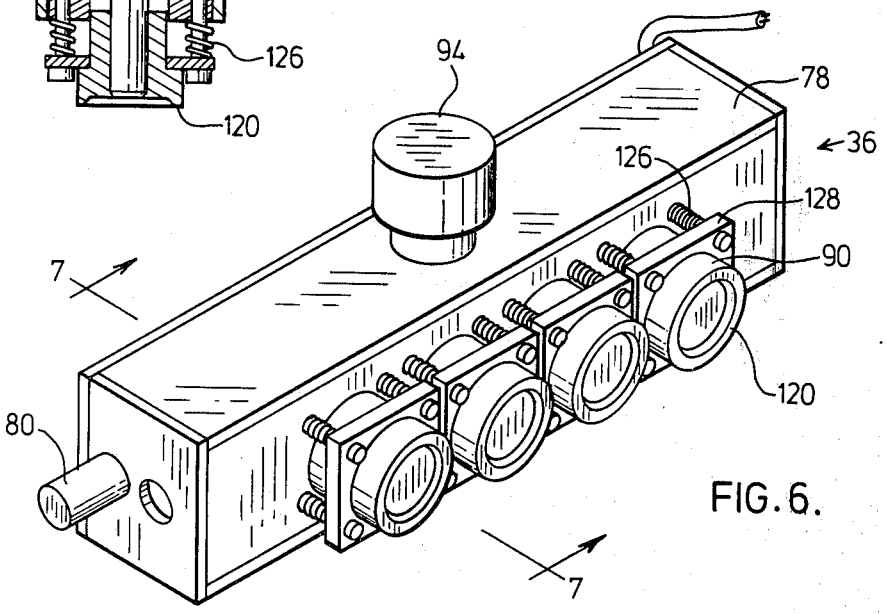
FIG. 6.

FIG.12.
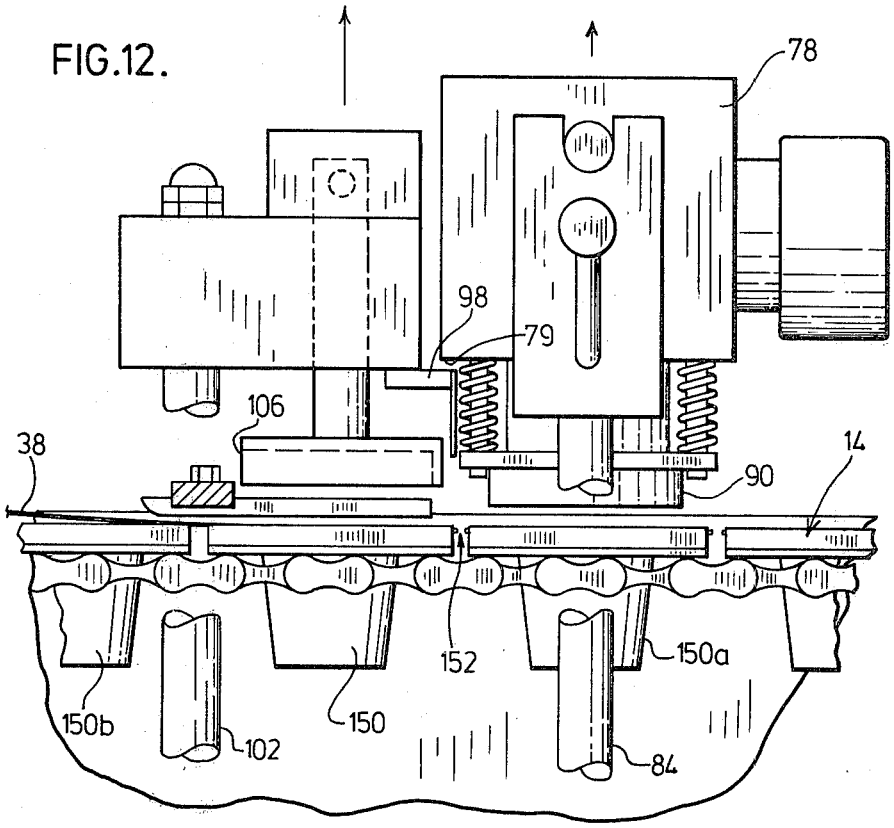
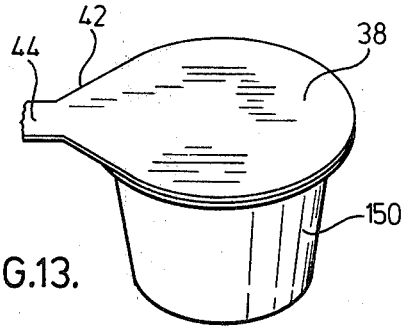
FIG.13.
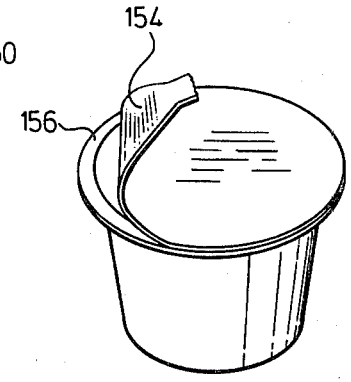
FIG.15.
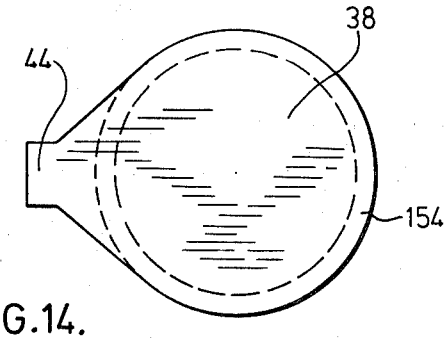
FIG.14.

CONDIMENT PACKAGING MACHINE

FIELD OF THE INVENTION

This invention relates to an apparatus and method for heat sealing a lid to a container. The lid being sealed is one of a supply of a series of lids interconnected by severable tabs. More particularly, the apparatus commences the heat-sealing operation prior to the lid being severed from the supply of lids and the interconnecting tab is severed prior to restart of conveyed container movement.

BACKGROUND OF THE INVENTION

In recent years there has been a substantial increase in the demand for packaging of individual portions of condiments, coffee cream, etc. As a result of this demand the technology related to packaging of these units has advanced. Previous methods of sealing a container by heat sealing techniques included the use of a sheet of heat sealable material being placed over the several containers, portions of which were heat sealed to underlying container rims. The containers would proceed to the next station where the sealed portions are di-cut from the sheet to form the container lids. This method relies on the feed sheet of material being aligned prior to the machine operating and the machine must be shut down if the sheet goes out of alignment because each sealing operation skews material further to one side. The initial misalignment may be quite small however this error is multiplied each time the conveyor is indexed. Another method of heat-sealing a lid to a container uses pre-cut lids interconnected by severable tabs as used in the present invention however the lid would be cut from the supply series of lids before the heat sealing operation. This second method minimizes the problem of aligning an interconnected lid with a conveyed container, however, control of the disconnected lid about to be sealed is minimal. This loss of control can cause operational problems due to lid mis-alignment as well as lid curling caused by moisture or radiant heat from heater blocks when the machine is momentarily shut down.

BRIEF SUMMARY OF THE INVENTION

The present apparatus uses a conveyor for moving containers to a lid heat sealing and tab severance station whereby the first lid of a supply series of like lids interconnected by severable tabs is heat sealed to the container. The apparatus is adapted to control the position of the lid to be sealed to a container up to and during the heat sealing operation. This aspect of lid position control minimizes the effect lid curling has on the ability to heat seal such lid to a container rim. Previous processes and machines have not been able to provide this feature of lid position control on a series of interconnected like lids. A further feature of this apparatus is that it may be adapted to self-realign the series of lids including the lid about to be heat sealed above a series of conveyed containers after a lid sealed to a container has been disconnected from the series of interconnected lids.

According to one aspect of the present invention, a driven conveyor has been adapted to equally space containers along the conveyor and provide support for the container rim during heat-sealing of a lid to the container. The drive means has been adapted to index the conveyor to thereby halt the conveyor movement at fixed intervals corresponding to the container spacing.

A lid of the supply series of like lids is synchronously positioned over the conveyed container rim. A lid heat-sealing and tab-severance station, at which containers are momentarily stationed by the drive means, comprises a reciprocal heat sealing pad synchronously driven to press an aligned lid onto a supported container rim and adapted to heat-seal the lid to the container. The means for severing the interconnecting tab associated with the heat sealed lid is synchronized to sever the tab prior to conveyor indexing.

According to another aspect of this invention, clamping pad means located upstream of the heat-sealing pads relative to direction of conveyor movement may be used to maintain the position of the series of like interconnected lids during severance of the sealed lid from the remaining series of interconnected lids.

According to other aspects of the invention, the conveyor may be adapted to receive and have nested therein the container body beneath the surface of the conveyor. A recessed area may be provided to receive a lid aligned over a container. The recess may have portions which contact edges of such lid. The design is such that the series of interconnected lids lie in these recesses, thus maintaining the aligned position of the series of like interconnected lids over underlying containers. As the conveyor is indexed, these recesses advance the aligned lids. The tolerance between the recessed portion of the conveyor and the lids, is less than the alignment tolerance of the lid to the container rim. Should the series of lids be moved slightly out of position during the severance of an interconnecting tab, then after the tab is severed, the freed series of lids are allowed to self-realign in the recessed portions of the conveyor. Thus a lid is always aligned with a conveyed container in preparation for heat sealing.

Another aspect of the invention provides a lid retention finger located below each clamping pad, proximate the upper surface of the conveyor to ensure the first lid of the series of interconnected lids remains in place as the tab severance means is retracted. The clamping pads have a recessed portion thus clearing the lid retension finger during the clamping operation. It is another feature of this retension finger to ensure the lids remain in the recessed areas of the conveyor.

DESCRIPTION OF THE DRAWINGS

These and other advantages and features of the invention will become apparent to those skilled in the art in the following detailed description of embodiments of the invention as shown in the drawings wherein:

FIG. 4 is a detailed view of the lid clamping and tab severance device of FIG. 3;

FIG. 5 is a section taken along the lines 5—5 of FIG. 4;

FIG. 6 is a detailed view of the underside of the heat-sealing device of FIG. 3;

FIG. 7 is a section taken along the lines 7—7 of FIG. 6;

FIGS. 9 through 12, show the sequence of reciprocating movement of the heat sealing, tab severance and lid clamping devices during the operation of the apparatus;

FIGS. 13 and 14 show various views of the container with a lid heat sealed thereto;

FIG. 15 demonstrates the removal of the lid from the container.

DETAILED DESCRIPTION OF THE PREFERRED EMBODIMENTS OF THE INVENTION

Figures 1, 2:
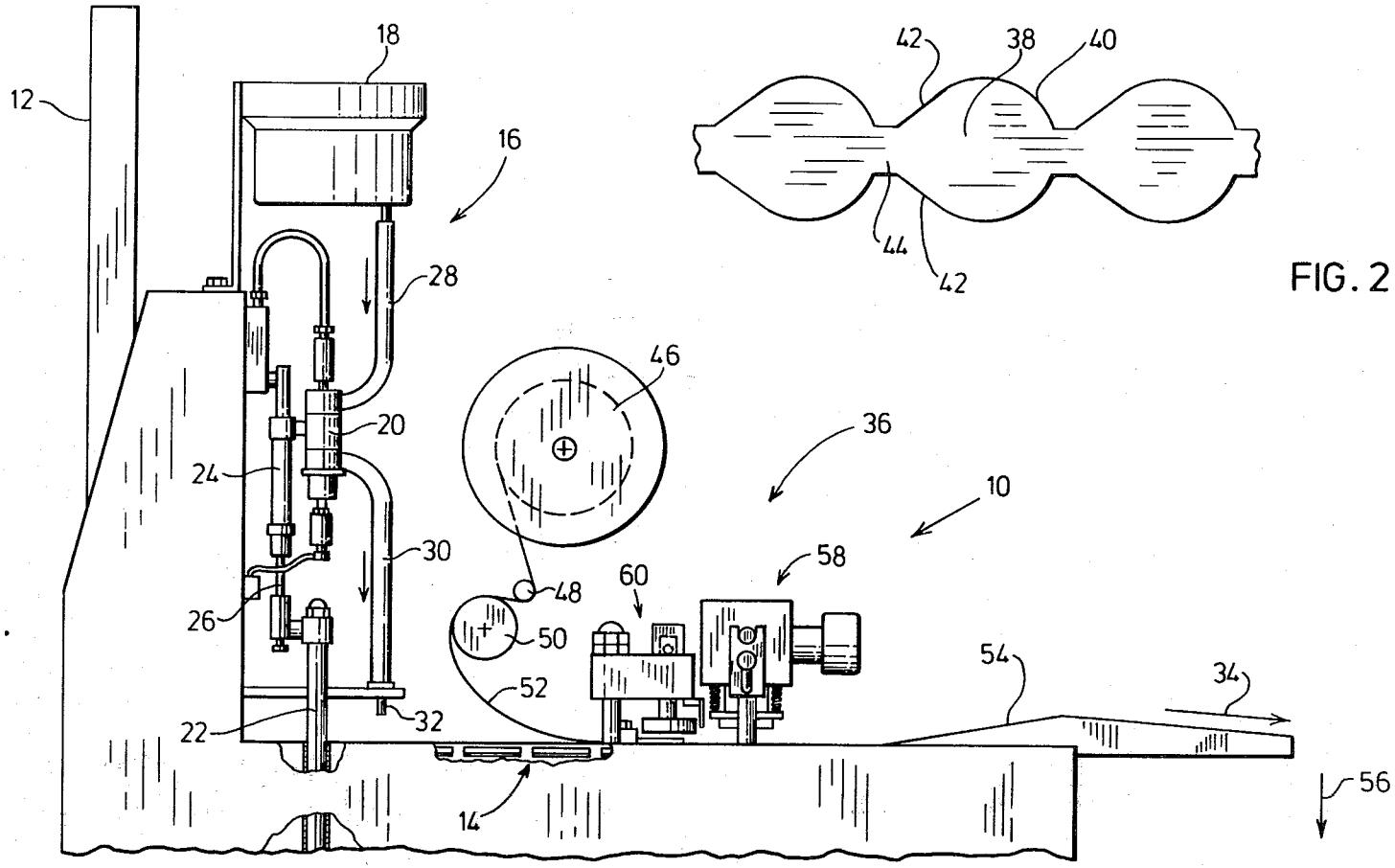
FIG. 1 is a side elevation of a preferred embodiment of a condiment packaging apparatus.
FIG. 2 is a top view of a supply of like interconnecting lids for condiment containers.

The principles of the invention with respect to heat sealing a lid on a container rim will be better understood by those skilled in the art with reference to a preferred embodiment of a condiment filling machine 10 as shown in FIG. 1. It is appreciated that, the heat sealing of a lid to a container may be used with respect to other types of filling or packaging machines for coffee cream, etc. The condiment packaging machine 10 includes a chute 12 which holds a supply stack of empty containers. Along the base of the apparatus, is a conveyor 14 on which the containers from chute 12 are placed. The condiment filling device 16 has a reservoir 18 with a valve 20 activated by pump 24 having reciprocating arm 22 connected to piston rod 26 to pump condiment from reservoir 18 through lines 28 and 30 to outlet nozzel 32. The movement of the conveyor 14 is indexed or halted by a drive means (not shown) so as to momentarily station an open container below nozzel 32 to receive a metered quantity of condiment. The container is then advanced to a tab severance and heat sealing station.

The lids to be heat sealed to the open container are a series of like interconnected lids of the type shown in FIG. 2. Such an arrangement for a supply of individual lids readily provides for advertising on each lid top; and lid alignment control ensures that the advertising is properly positioned in each container. Each lid 38 is teardropped shaped having a rounded forward portion 40 which merges into linear side-wall portions 42. The lids are interconnected by tab 44. When a lid is disconnected from the series, it has the shape shown in FIG. 14.

The supply of these like interconnected lids is on a rotatable drum 46 from which the series of lids is trained over a tensioning roller 48 and feed roller 50. The feed roller is equipped with spaced-apart lugs which are configured to contact the planar surfaces 42. The movement of feed drum 50 is such to provide a looping portion 52 as the series of lids descends to the level of the conveyor 14 and the feed drum movement is synchronized with the conveyor movement to position a lid 38 over each filled container. The loop 52 serves to compensate for irregular movements in the series of lids as they are married with the conveyor recesses in the manner to be discussed with respect to FIG. 3.

The heat sealing and tab severance station 36 serves to seal a lid 38 to a container while the series of lids are clamped and the tab 44 severed, to free the sealed lid from the series of like lids. The drive means indexes the conveyor 14 until the sealed container moves up ramp 54 and is discharged in the direction of arrow 34 to be dropped in the direction of arrow 56 to a receiving carton.

The heat sealing and tab severance station 36 comprises a reciprocal heat sealing device 58 and a reciprocal tab severance and lid clamping device 60 located upstream of the sealing device. In this embodiment, the heat sealing device comprises heater blocks with electric elements which heat the blocks to very high temperatures. The movement of heat sealing device 58 is such that it remains in contact over an extended period of time with the lid pressed onto the container to ensure a sealing of lid to container. It is understood that other types of sealing devices may be used such as a high-frequency heat sealing device which functions in a different manner with respect to heat sealing the lid to the container. Pressure would be necessitated, however, by way of reciprocating blocks to complete the seal. The tab severance and clamping device 60 operates to clamp the series of lids in position prior to tab severance.

Figure 3:
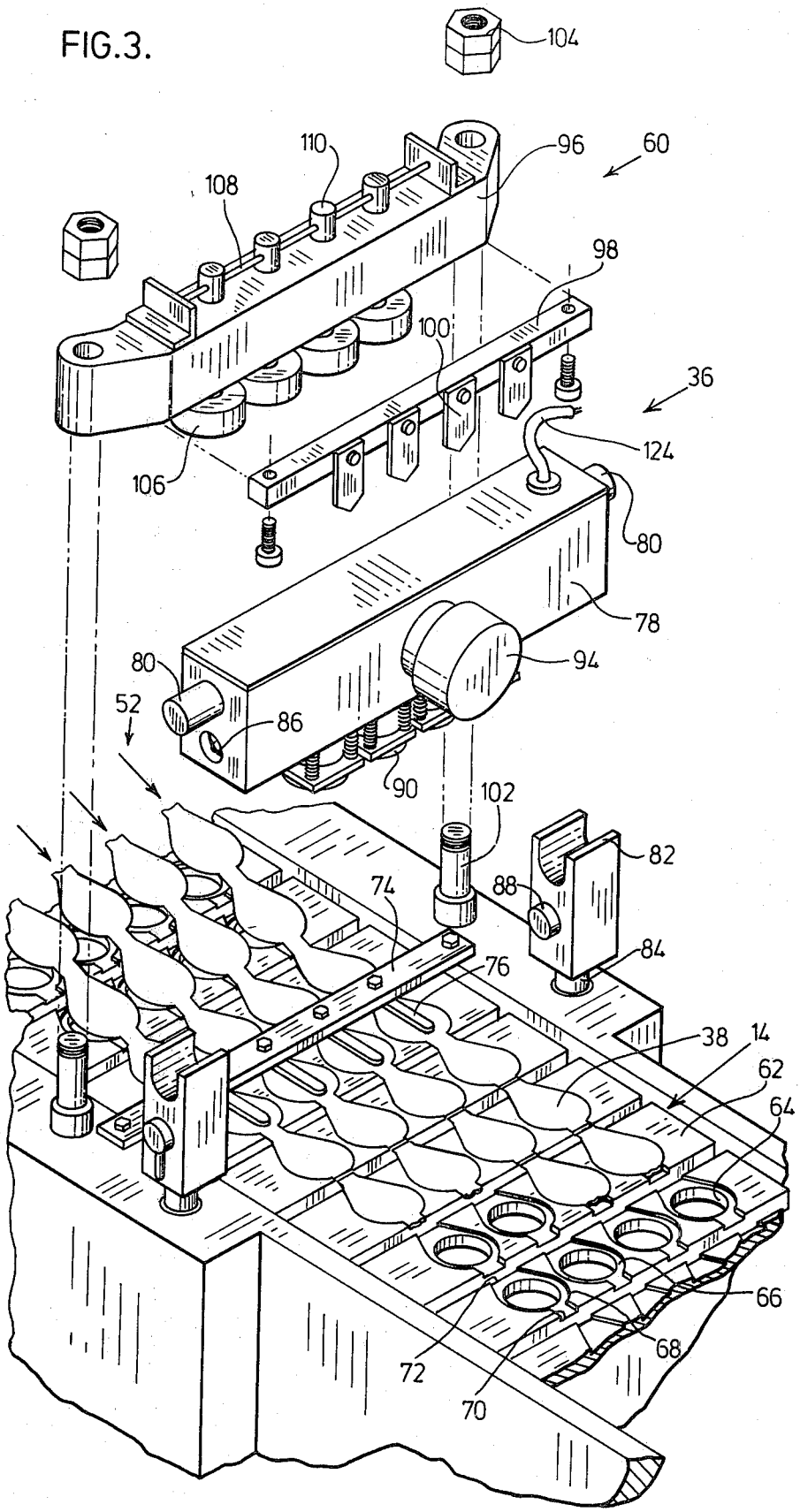
FIG. 3 is an exploded view of the heat sealing, tab severance and lid clamping station of the apparatus of FIG. 1.

FIG. 3 shows an exploded view of the station 36. The conveyor 14 has a bed portion formed of a series of plates 62 interconnected by chains 61 (shown in FIG. 9) driven by drive means to advance the conveyor in a stepwise or indexed manner. The step-wise advance of the conveyor is related to the spacing between openings 64 in each plate. There are four openings in each plate, each of which receives a container body and has the rim rest on the circumferential recessed ledge portion 66 having a partially surrounding abutment 68 in the shape of the lid. Interruptions 70 and 72 in the abutment accommodate the interconnecting tabs 44 of the series of lids. The shape of the ledge or shoulder 68 is such to at least snugly receive the planar portions 42 of the four series of lids so that the conveyor, as it picks up the four loops 52 of lids, advances the lids aligned over the containers. As can be seen, the looped portion of lids 52 falls into the recessed portion 66 and is picked up by abutment 68. This provides an exacting manner for aligning the lids with the unsealed containers as the supply series of lids must interact with the conveyor. Positioned above the conveyor 14 is a plate 74 having secured thereto a plurality of fingers 76 which are below the plane of the upper surface of conveyor plate 62 to ensure that the lids are received within the recesses and remain therein during advance of the conveyor. The fingers 76 also ensure that the lids remain in the recesses during the tab severance operation which will be discussed in more detail hereafter.

The heat sealing device 58 has a block portion 78 with outwardly extending support arms 80 which are received in yokes 82 which in turn are connected to reciprocating rods 84. Beneath arms 80 are recesses 86 which receive retractable lugs 88 so that when mated, they serve to lock the block 78 with the heating elements 90 extending downwardly. The electric supply for heater elements 90 is by wire 124. For purposes of servicing the heater elements, the lugs 88 may be withdrawn and by grasping handle 94, the unit may be swung to position the heater elements 90 upwardly and outwardly from the conveyor bed 14.

The tab severance and clamping device 60 comprises a block 96. Mounted on the underside thereof is a bar 98 having a plurality of spaced apart knives 100. The block 96 is secured to reciprocating rods 102 by nuts 104. Also provided in block 96 are spring loaded clamping elements 106 which are held in register by rod 108 extending through shaft memebers 110. The underside 114 of the clamping pads 106 each have a recess 112 as shown in FIG. 4 to receive finger elements 76 when the clamps are moved downwardly to sandwich a lid between the pad face 114 and the circumferential bed 66.

As shown in FIG. 3, the lids 38 after having been sealed to the containers, have their interconnecting tab portions 44 severed to free the sealed lids from the rows of like lids. The sealed containers are conveyed in a step-wise manner and discharged at 56.

Turning to FIG. 4, various details of the tab severance and clamping means of FIG. 3, are shown and numerically designated. As shown in FIG. 5, each clamping pad 106 has its rod portion 110 spring loaded at 118. The knife elements 100 are positioned outwardly of the edge of clamping pads 106 so that on the downstroke of the rod 102, they sever the interconnecting tabs 44.

The heating sealing device 58 has four spaced apart heating elements 90 which have an annular ridge 120 corresponding to the shape of the container rim. As shown in FIG. 7, a heater element 122 electrically powered by cord 124, heats the face 120 of the heater block to a sufficient temperature so that the prescribed contact time of the heater face 120 is sandwiching the lid between it and the container rim provides the necessary heat to seal the lid to the container rim. With this type of heat sealing, the isolation of heater block portion 78 from clamping block portion 96 prevents conduction of heat to and raising the temperature of the clamping elements 106 and knives 100. This precludes damage to the lid by eliminating premature exposure to heat. The faces 120 of the heater elements 90 may be covered with a fiberglass cloth material impregnated with Teflon (trademark) or other suitable material to minimize adhesion of material to its face. This cloth could be held in position by a spring retaining means (not shown) recessed in the sides of the heater elements. The heater elements 90 are spring loaded to block 78 by a plurality of springs 126 between the block 78 and plate 128 of each element. The springs are compressed during the heat sealing operation and they are capable of accomodating variations in material thicknesses and conveyor level variations.

Figure 8:
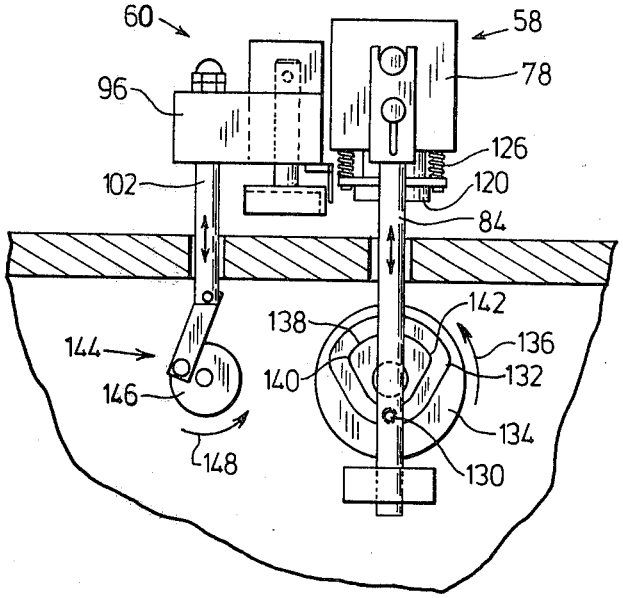
FIG. 8 shows the drive mechanism for the heat-sealing and tab severance station.

Turning to FIG. 8 the device for reciprocating the heat sealing and tab severance station is shown. As mentioned, that heater block 78 of the heat sealing device 58 is connected to reciprocating rod 84. Rod 84 extends below the level of conveyor 14 and has mounted thereon a cam follower 130 (shown in dot). The cam follower is mounted in a bell-shaped groove 32 defined in a circular body 134 which is rotated in the direction of arrow 136. The groove 132 is of a width slightly greater than the cam follower 130 to prevent binding thereof. Segment 138 of the cam face provides the extended contact time of the heater face 120 with the lid. Due to the arcuate shape of segment 138 it is apparent that the pressure increases gradually from point 140 to the mid-area and then decreases to point 142. Beyond point 142, the face 120 is withdrawn from the lid. The spring members 126 are compressed varying degrees while the cam follower 130 engages segment 138. At the maximum portion of segment 138 the pressure exerted by face 120 may be in the range of 30 to 60 lbs/in$^2$.

Synchronized with the movement of the heater block 58 is the movement of the clamping and tab severance device 60. Reciprocating rod 102 extends below the level of the conveyor and is connected to a crank arrangement 144. The crank arrangement, by rotation of wheel 146 in the direction of arrow 148, moves the tab severance and lid clamping device up and down. There is no delay time provided for in the downward and upward movement of the tab severance device 60 except for the top and bottom portion of its movement when the crank system is at top dead centre and bottom dead centre. The pressure exerted by the clamping pads is less than that of the heater elements and at bottom dead centre the clamping pads may exert pressure in the range of 10 to 20 lbs/in$^2$.

It is apparent that the block portion 78 and 96 may be integral or common. For this arrangement only one reciprocating device would be necessary where the positioning and spring loading of the clamping pads and heater pads would be such that on the downstroke of the common block, the pads exert sufficient compressive forces to hold the lids in position while the knife severs the interconnecting tab.

Figure 9:
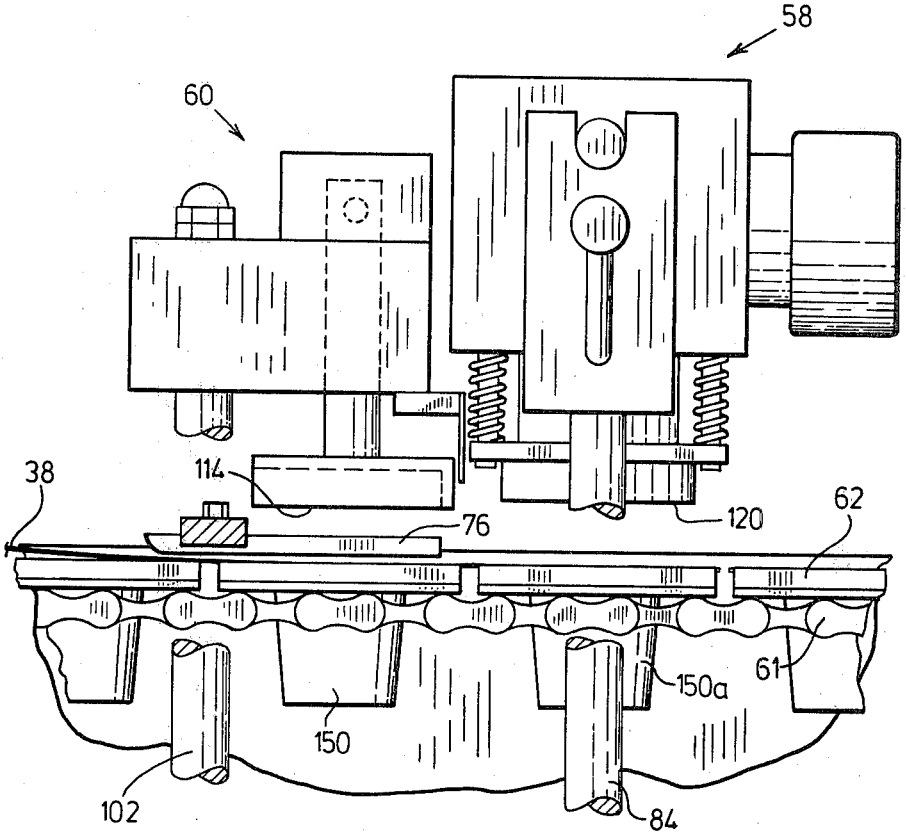

The rotation of the crank device 144 and the cam wheel 134 are synchronized to provide for the sequence of positions as shown in FIGS. 9, 10, 11 and 12. In FIG. 9, the downward movement of the clamp and tab severance device 60 has begun. The heat sealing device 58 is in its upper position with the heater face 120 clear of the conveyor.

It should be noted that the movement of the conveyor is synchronized so that it is moving only while the heater elements and clamping pads are clear of the conveyor. At any other time the conveyor movement is halted whereby two adjacent rows of 4 containers are located beneath the corresponding row of heater elements and corresponding row of clamping pads. It should also be noted with respect to FIG. 9, that the spacing between the face of the heater element 120 and the clamping pad face 114 is equal to the spacing between two containers 150 and **150*a***.

Figure 10:
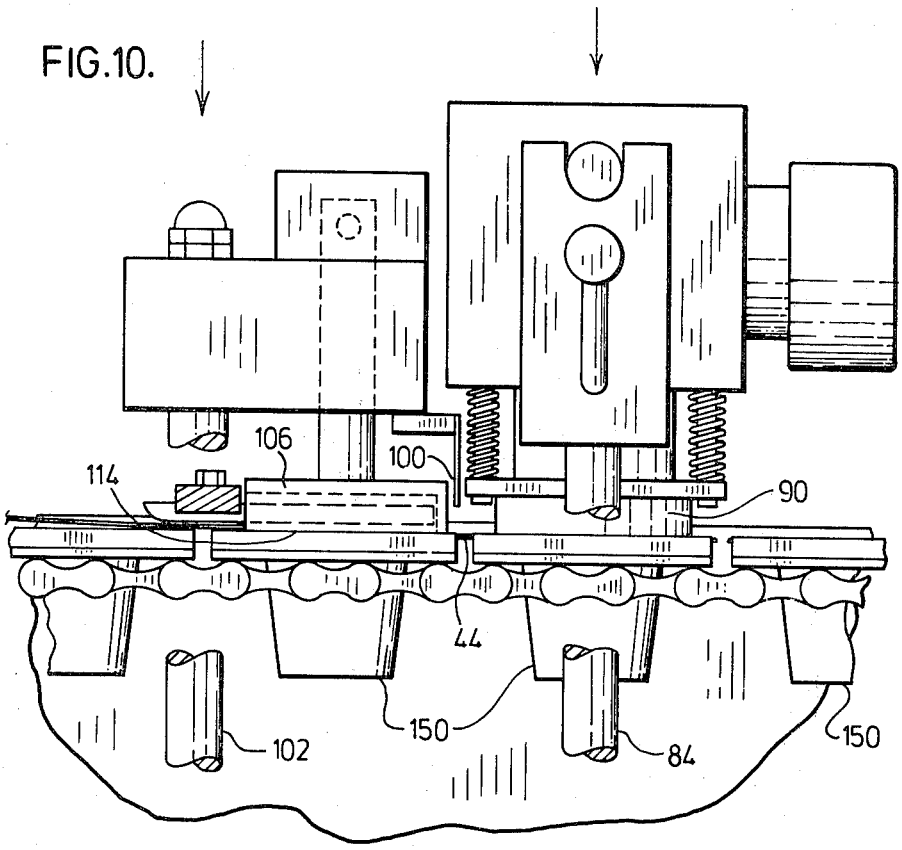

Turning to FIG. 10 the rod 102 has moved further downwardly by the crank device 144 so that the clamp pad 106 has its face 114 contacting a lid and forcing it against a container rim in the recessed portion of the conveyor bed where finger 76 is received within the recess of the pad. Meanwhile, the leading portion of knife 100 is clear of tab 44. Along with the downward movement of the clamping pad 106, the heater element 90 has been moved downwardly by the cam device 134 so that the lid is sandwiched between the face 120 of the heater element and the container rim in the conveyor bed.

Figure 11:
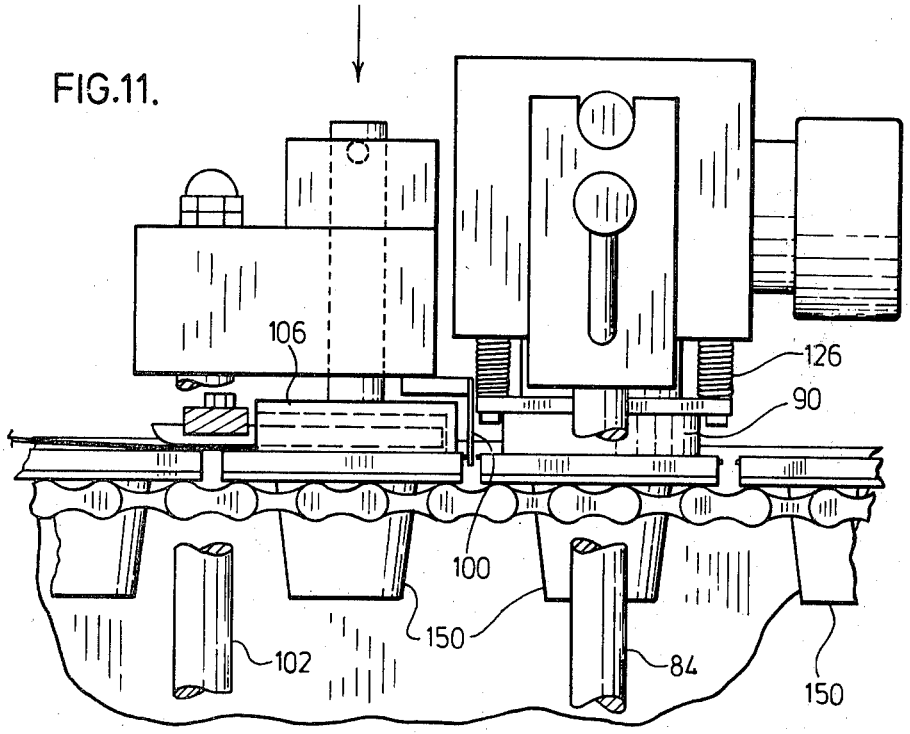

Turning to FIG. 11, the clamping pad 106 is exerting a greater downward force on the lid due to the compression of internal spring 118 to the extent as shown. Simultaneously with this compression of spring 118, the leading edge of knife 100 has moved downwardly far enough to sever the interconnecting tab 44. Coincident with the clamping pad compression, the heater block 78 is moved further downwardly to increase the compressive forces as indicated by the compression of springs 126 to ensure a proper heat sealing of the lid to the container.

As shown in FIG. 12, retreat of both the heater element 90 and clamping pad 106 has commenced as determined by the synchronous movement of cam wheel 134 and crank device 144. There is no longer compression in the spring devices of the heater block and clamp block. The rate of withdrawal of the heater pad 90 is such that there is no interference between the plate 98 carrying the knives 100 and the underside 79 of block 78. At this point the interconnecting tab 44 has been severed to provide a clean cut generally designated at 152. This frees the sealed lid from the remaining series of interconnected lids and the sealed container is free to move onwardly and be discharged. The conveyor 14 is now advanced to place container **150*b*** to lie beneath the clamping pad 106 with a lid 38 aligned thereabove. It is apparent that at station 36 an aligned lid is heat sealed to a container and prior to its movement away from the heat sealing station, the interconnecting tab 44 is severed by knives 100. Meanwhile, the clamping device acts on a preceeding lid to hold the series of lids in position during severance of tab 44.

FIG. 14 shows a lid 38 heat sealed to a container rim where the heat sealing area is generally designated as an annular portion 154. The sealed container as shown in FIG. 13 has the tab portion 44 projecting outwardly from the edge of the container 150. The tab portion 44, due to planar portions 42, does not provide any sharp breaks at the edge of the container. This facilitates the removal of a lid 38 from the container as shown in FIG. 15 because of minimal enducement to tearing of the tab 44 away from the lid 38 as the heat sealed portion 154 breaks away from the container rim 156. In providing this type of tab in relationship to the lid, one is assured of clean access to the container without having to tear away remaining portions of the lid.

From the above description of operation of a preferred mode for the apparatus according to this invention, it is apparent that control on the lid position is provided up to and during heat sealing of a lid to an underlying container. This ensures accuracy of locating lids on containers on a continuous basis. Further and in particular with the heat sealing device of this embodiment, the heater face 120 is heated by electrical element 122 to temperatures in the 300° F. to 600° F. range, varying with the lid sealing material, the speed of production and the cloth material covering the surface of the heater elements. It is apparent that the heater pads at these temperatures remain hot over extended periods. During momentary shut down of the apparatus it may occur that the lid directly beneath the heating element which has not yet been sealed to the container begins to curl upwardly due to the radiant heat. However, tab portion 44 as it interconnects the lids 38 and is held down by finger 76 prevents the rear part of the lid curling upwardly. Further the extent of the upward curl with the leading portion of the lid to be sealed is minimal and in most instances would not curl underneath the face 120. As a result on restarting of the apparatus, the face 120 comes downwardly on the partially curled lid to lay it out over the container rim and form the seal.

A further function of the finger 76 is to prevent the lid underneath the clamping pad 106 from being lifted upwardly on withdrawal of the knife from the conveyor bed and ensure the removal of the clamping pad from the lid so that the lid remains within the recess and is aligned with the container to be sealed.

The operation of the heat sealing device 58 in combination with the means for feeding the lids to the conveyor and the conveyor recesses provides for self-realignment of the lids relative to the containers nested in the conveyor bed. Once the knife 100 severs the interconnecting tab, the series of lids are freed from the sealed lid. Any forward movement of the series of lids in the conveyor bed as may be caused by the knife severing the tab, is counteracted by the looped portion 52 in drawing the lids rearwardly until the planar portions 42 of the lids seat against abutments 68 in each conveyor recess to realign the lids over the container tops. In combination with the aspect of the looped portion 52 inherently drawing the series of lids rearwardly relative to the conveyor movement, there is also the aspect that as the conveyor is advanced, the planar portions 42 will be drawn into the abutments 68 due to the conveyor movement accelerating the series of lids. Therefore the conveyor interacts with the series of lids maintaining the position of the series over the containers preparatory to the head sealing operation. The movement of feed drum 50 is synchronized with the indexed movement of the conveyor to always ensure that there is the looped portion 52 of the series of lids.

The lid 38 may be of paper construction laminated with an aluminum foil which has a thin layer of thermoplastic material or wax-like composition so as to be readily heat sealable to a container by the application of heat to the composition.

Although various embodiments of the invention have been described herein in detail it will be understood by those skilled in the art that variations may be made thereto without departing from the spirit of the invention or the scope of the appended claims.

The embodiments of an invention in which an exclusive property or privilege is claimed are defined as follows:

1. In an apparatus adapted to heat seal a lid or a series of like lids interconnected by severably tabs to an open container; a driven conveyor for conveying containers and having locating means for equally spacing containers along said conveyor; means for supporting container rim during heat sealing of a lid to such container; drive means adapted to index said conveyor to thereby halt conveyor movement at fixed intervals corresponding to such container spacing; means for synchronously positioning a lid of such series over conveyed container prepatory to heat sealing lid to container rim; alignment means in association with said conveyor to interact with such supply series of lids and thereby maintain the position of such supply series of lids over the containers preparatory to heat sealing a lid to container rim; a lid heat sealing and tab severance station at which containers are momentarily stationed by said drive means; said station comprising a reciprocal heat sealing pad synchronously driven to press an aligned lid onto a supported container rim and adapted to heat seal such lid to such container and means for severing interconnecting tab associated with such heat sealed lid; said severance means being synchronized to sever such tab prior to said drive means indexing said conveyor to thereby free such series of lids from such sealed container.

2. In apparatus as defined in claim 1, wherein said alignment means includes a plurality of openings in said conveyor of sufficient size to enable the body of the container to be nested in the conveyor having a recessed area about such openings adapted to receive one such lid of such series of interconnected lids; said recess interacting with such lid to maintain alignment of lid over container as the conveyor is indexed.

3. In apparatus as defined in claim 2 further comprising a reciprocating clamping pad spaced upstream of said heat sealing pad corresponding to such container spacing, the movement of said clamping pad being synchronized with movement of said heat sealing pad and said knife such that said clamping pad and said heat sealing pad exert sufficient pressure on such lids to maintain the position of such lids during the severance of interconnected lids, said clamping pad exerting pressure on such lid by compressing a second spring means located with said clamping pad.

4. In apparatus as claimed in claim 1, adapted to seal a plurality of containers at once, said conveyor having a plurality of said locating means spaced across the width; said lid heat sealing and tab severance station having a plurality of said heat sealing pads spaced across and over said conveyor.

5. In apparatus as defined in claim 4, wherein said heat sealing pads have a projecting surface adapted to contact a portion of such lid immediately above the rim of such container.

6. In apparatus as defined in claim 4, wherein said heat sealing pads exert pressure on such lid by compressing a first spring means associated with said heat sealing pads.

7. In apparatus as defined in claim 5, wherein said severance means comprises at least one vertical reciprocating knife.

8. In apparatus as defined in claim 4, wherein said conveyor has a plurality of openings of sufficient size to enable the body of the container to be nested in the conveyor; said conveyor having a recessed area about such openings adapted to receive one such lid of such series of interconnected lids, said recess interacting with such lid to maintain alignment of lid over container as the conveyor is indexed.

9. In apparatus as defined in claim 8, further comprising reciprocating clamping pads spaced upstream of said heat sealing pads corresponding to such container spacing, the movement of said clamping pads being synchronized with movement of said heat sealing pads and said knife such that said clamping pads and said heat sealing pads exert sufficient pressure on such lids to maintain the position of such lids during the severance of interconnected lids.

10. In apparatus as defined in claim 9, wherein said heat sealing pads, said clamping pads, and said knives are supported by a common block, said heat sealing pads and said clamping pads exerting pressure on such lids by compressing a spring means associated with them, said knife severing such interconnecting tabs only after sufficient compression of said spring means to maintain lid position.

11. In apparatus as defined in claim 10, wherein said common block and said heat sealing pads are adapted to minimize heat conduction from said heat sealing pads to said knife and said clamping pads.

12. In apparatus as defined in claim 7, wherein said heat sealing pads are adapted with a cloth material covering the surface of said pad exposed to such lid to minimize adhesion between said heat sealing pad and such lid.

13. In apparatus as defined in claim 7, further comprising a cam and lever mechanism for reciprocating said heat sealing pads; said cam being of a design such that such heat sealing pads are essentially stationary with respect to the lid during a major portion of the heat sealing operation.

14. In apparatus as claimed in claim 1, wherein such supply series of lids are fed to the base of the conveyor at an oblique angle and aligned with the direction of movement of the conveyor.

15. In the process for heat sealing an individual rimmed plastic container with the first lid of a thermal reactive series like lids interconnected by severable tabs comprising the steps of supporting the container rim, moving the container along a predetermined path, advancing the series of lids by the movement of the containers, adjusting the position of the first lid of such series of lids above the container as the container is moved, momentarily halting the container movement clamping said series of lids, heat sealing such lid to such container by applying pressure and heat to such lid, severing such interconnecting tab of the sealed lid prior to resumed movement of the container and to unclamping said series of lids, and advancing another container with an aligned lid in preparation for the heat sealing step.

16. A process for heat sealing of an individual rimmed plastic container with the first lid of a thermo reactive series of like lids interconnected by severable tabs comprising the steps of supporting the container rim and momentarily halting its movement, aligning a lid above the container, clamping said series of lids, heat sealing such lid to such container by applying pressure and heat to such lid, severing such interconnecting tab of the sealed lid prior to resumed movement of the container and to unclamping said series of lids, and advancing another container with aligned lid in preparation for the heat sealing step, wherein the movement of the containers causes a responsive movement of said series of lids maintaining the alignment of said series of lids above said containers.

17. In the process as claimed in claim 16, including aligning said series of lids with the direction of movement of said containers.

18. In an apparatus adapted to heat seal a lid of a series of like lids interconnected by severable tabs to an open container; a driven conveyor for conveying containers and having locating means for equally spacing containers along said conveyor; means for supporting container rim during heat sealing of a lid to such container; drive means adapted to index said conveyor to thereby halt conveyor movement at fixed intervals corresponding to such container spacing; means for synchronously positioning a lid of such series over conveyed container preparatory to heat sealing lid to container rim; a lid heat sealing and tab severance station at which containers are momentarily stationed by said drive means; said station comprising a reciprocal heat sealing pad synchronously driven to press an aligned lid onto a supported container rim and adapted to heat seal such lid to such container; said heat sealing pad having a projecting surface adapted to contact the portion of such lid immediately above the rim of such container and a vertical reciprocating knife for severing the interconnecting tab associated with such heat sealed lid; said knife being synchronized to sever such tab prior to said drive means indexing said conveyor to thereby free such series of lids from such sealed container, said apparatus further comprising a cam and lever mechanism for reciprocating said heat sealing pad; clamping pad located upstream of said heat sealing pad synchronized with said heat sealing pad and said knife to maintain the position of such supply series of lids during severance of interconnected lids; a retention finger located below said clamping pad, proximate the upper surface of the conveyor; said clamping pads being recessed to clear said retention finger when clamping one lid of such series of interconnected lids; said cam being of a design such that said heat sealing pad is essentially stationary with respect to the heat sealed lid during a major portion of the heat sealing operation.

* * * * *